US008913776B2

(12) United States Patent
Maezawa et al.

(10) Patent No.: US 8,913,776 B2
(45) Date of Patent: Dec. 16, 2014

(54) CRADLE APPARATUS

(75) Inventors: Yasuyuki Maezawa, Kanagawa (JP); Ryota Matsumoto, Tokyo (JP); Kazuya Ishii, Tokyo (JP)

(73) Assignee: Sony Corporation, Tokyo (JP)

( * ) Notice: Subject to any disclaimer, the term of this patent is extended or adjusted under 35 U.S.C. 154(b) by 320 days.

(21) Appl. No.: 13/195,138

(22) Filed: Aug. 1, 2011

(65) Prior Publication Data

US 2012/0063630 A1 Mar. 15, 2012

(30) Foreign Application Priority Data

Sep. 14, 2010 (JP) ..... 2010-205943

(51) Int. Cl.
*H04R 1/02* (2006.01)
*H04R 1/34* (2006.01)

(52) U.S. Cl.
CPC ..... *H04R 1/345* (2013.01); *H04R 2205/021* (2013.01); *H04R 2420/09* (2013.01)
USPC ..... 381/386; 381/58; 381/334

(58) Field of Classification Search
USPC ..... 381/386, 395, 388
See application file for complete search history.

(56) References Cited

U.S. PATENT DOCUMENTS

| | | | | |
|---|---|---|---|---|
| 5,123,500 | A * | 6/1992 | Malhoit et al. | 181/144 |
| 6,009,972 | A * | 1/2000 | Choi et al. | 181/155 |
| 6,257,365 | B1 * | 7/2001 | Hulsebus, II | 181/155 |
| 2003/0042068 | A1 * | 3/2003 | Lee | 181/155 |
| 2003/0076951 | A1 * | 4/2003 | Tomura et al. | 379/419 |
| 2005/0255895 | A1 * | 11/2005 | Lee et al. | 455/573 |
| 2006/0209530 | A1 * | 9/2006 | Schaak | 362/86 |
| 2010/0321871 | A1 * | 12/2010 | Diebel et al. | 361/679.01 |
| 2011/0143583 | A1 * | 6/2011 | Zilmer et al. | 439/529 |

FOREIGN PATENT DOCUMENTS

JP 2008-166951 7/2008

* cited by examiner

*Primary Examiner* — Duc Nguyen
*Assistant Examiner* — Phan Le
(74) *Attorney, Agent, or Firm* — Sony Corporation

(57) ABSTRACT

A cradle apparatus includes a casing, a mounting unit provided to the casing so that an electronic device is mounted thereto, and a speaker provided only to a bottom portion of the casing and having a downward vibration plate which emits a sound supplied from the electronic device mounted to the mounting unit.

16 Claims, 9 Drawing Sheets

STATE WHERE DIFFUSER IS REMOVED

CRADLE APPARATUS

BACKGROUND

The present disclosure relates to a cradle apparatus, and more particularly, to a cradle apparatus having a sound output function.

In the related art, as a cradle apparatus for electronic devices, various kinds of cradle apparatuses are suggested. This kind of cradle apparatus allows an electronic device to be placed thereon, and further, when an electronic device is placed thereon, a connector provided to the placing surface is inserted into a connector of the electronic device so that the cradle apparatus is electrically connected to the electronic device (for example, see Japanese Unexamined Patent Application Publication No. 2008-166951).

In this configuration, the cradle apparatus may, for example, supply power to the electronic device to charge the electronic device or may relay the electronic device to an external device to establish communication between the electronic device and the external device.

In addition, as a cradle apparatus for a digital audio player (hereinafter, referred to as DAP), there is a speaker-attached cradle apparatus which has right and left speakers provided at the front surface of a casing so that a music supplied from the DAP is output through the speakers.

SUMMARY

However, the speaker-attached cradle apparatus should have a greater front surface portion in comparison to a general cradle apparatus without a speaker since the speaker-cradle apparatus has speakers at the front surface portion of the casing. In addition, the bottom portion should also be great (specifically, to have a great depth) in addition to the front surface portion of the casing so that the casing does not fall down even when the DAP is mounted thereto.

As described above, there is a problem in that larger casing is necessary for the speaker-attached cradle apparatus of the related art in comparison to general cradle apparatuses and miniaturization thereof is difficult.

It is desirable to provide a cradle apparatus which may be easily miniaturized while being provided with a speaker.

According to an embodiment of the present disclosure, there is provided a cradle apparatus which includes a casing, a mounting unit provided to an upper end portion of the casing to mount an electronic device thereto, and a speaker provided only at a bottom portion of the casing and having a downward vibration plate which outputs a sound supplied from the electronic device mounted to the mounting unit.

The speaker having a downward vibration plate is provided only at the bottom portion of the casing as described above. In this way, if the bottom portion of the casing has a size corresponding to the vibration plate of the speaker, the other portions may have any size as long as the cradle apparatus does not fall down even in a state in which an electronic device is mounted thereto. In other words, the other portions than the bottom portion of the casing may easily be miniaturized.

According to the embodiment of present disclosure, if the bottom portion of the casing has a size corresponding to the vibration plate of the speaker, the other portions may have any size as long as the cradle apparatus does not fall down even in a state in which an electronic device is mounted thereto. In other words, the other portions than the bottom portion of the casing may be easily made small, and in this way, it is possible to easily realize a cradle apparatus which can be easily miniaturized in comparison to the case where a speaker is provided to the front surface of the casing.

DETAILED DESCRIPTION OF EMBODIMENTS

Hereinafter, an embodiment of the present disclosure will be described. In addition, the description will be made in the following order.

1. Embodiments
2. Modifications

1. Embodiments

[1-1. Configuration of Audio System]

Figure 1B:
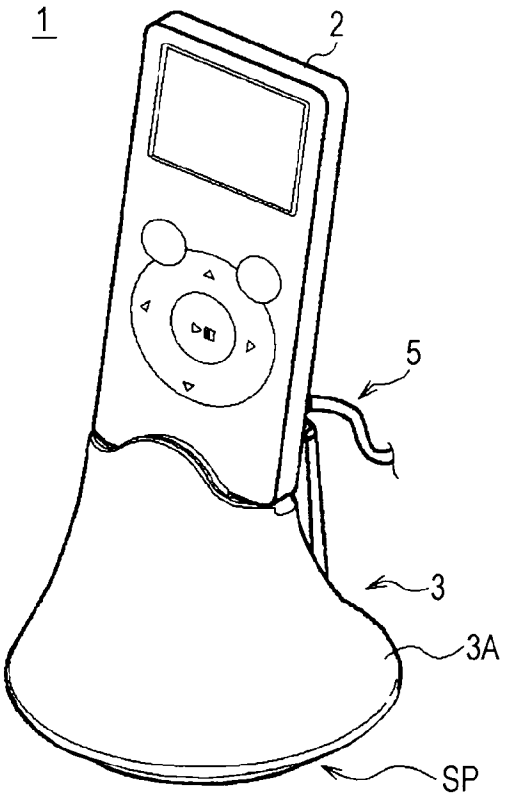
FIGS. 1A and 1B are schematic views showing a configuration of an audio system.
Figure 1A:
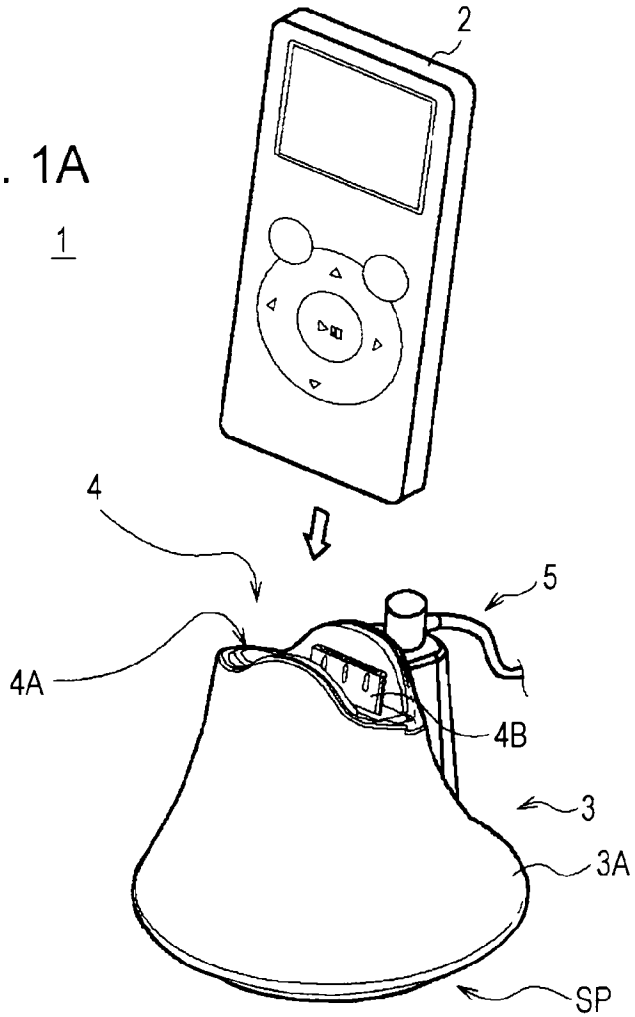

In FIGS. 1A and 1B, 1 represents an audio system as a whole. The audio system 1 includes a DAP (Digital Audio Player) 2, and a speaker-attached cradle apparatus 3 for the DAP 2. In addition, the speaker-attached cradle apparatus 3 is called just a cradle apparatus 3 here.

In the audio system 1, the cradle apparatus 3 is placed on an installation surface of a floor or the like, and the DAP 2 is mounted to a placing surface 4A of a mounting unit 4 provided at the upper end portion of a casing 3A of the cradle apparatus 3 to stand thereon. At this time, a connector 4B protruding from the placing surface 4A is put into a connector (not shown) provided at the bottom portion of the DAP 2 so that the cradle apparatus 3 is electrically connected to the DAP 2.

Here, if the DAP 2 is manipulated to generate music, sound signals based on music data are supplied from the DAP 2 to the cradle apparatus 3. In addition, a sound based on the sound signals is output from a speaker SP provided at the bottom portion of the casing 3A of the cradle apparatus 3.

As described above, in the audio system 1, the sound based on music data stored in the DAP 2 may be output from the speaker SP of the cradle apparatus 3.

In addition, in the audio system 1, in a case where an AC adaptor 5 is connected to the casing 3A of the cradle apparatus 3, the power input to the cradle apparatus 3 may be supplied to the DAP 2 via the AC adaptor 5 to charge the battery of the DAP 2.

As described, in the audio system 1, if the DAP 2 is placed on the cradle apparatus 3, the cradle apparatus 3 functions as an externally-attached speaker of the DAP 2 and also functions as a charger of the DAP 2. Hereinafter, the cradle apparatus 3 will be described in more detail.

[1-2. Appearance of Cradle Apparatus]

First, the appearance of the cradle apparatus 3 will be described with reference to FIGS. 2A to 4B. As shown in FIGS. 2A to 3, the casing 3A of the cradle apparatus 3 has a bottom-spreading bell shape as if a brass musical instrument such as a trumpet were to stand on the installation surface such as a floor with its front end portion being oriented downwards.

In addition, here, while looking from the front of the cradle apparatus 3, a direction from the left to the right is defined as an X direction, a direction from above to the below is defined as a Y direction, and a direction from the front to the rear is defined as a Z direction.

The casing 3A has the mounting unit 4 at its upper end portion, and the connector 4B is installed to protrude on the placing surface 4A formed in the mounting unit 4. In addition, the speaker SP is provided to the bottom portion of the casing 3A.

A front convex portion 4C and a rear convex portion 4D having a semi-disk shape are formed at front and rear sides of the placing surface 4A of the mounting unit 4 of the casing 3A. Therefore, if the DAP 2 is placed on the placing surface 4A, the lower end portion of the DAP 2 is inserted between the front convex portion 4C and the rear convex portion 4D.

Here, the placing surface 4A has substantially the same shape as the bottom portion of the DAP 2 (for example, a laterally-elongated rectangular shape). However, the placing surface 4A is formed greater than the bottom portion of the DAP 2 by several millimeters in a front and rear direction.

In this configuration, when the DAP 2 is placed on the placing surface 4A, a gap of several millimeters is created between the lower end portion of the DAP 2 and the front and rear convex portions 4C and 4D located at the front and rear of the placing surface 4A.

This gap allows the DAP 2 received in a silicon cover or clear casing to be mounted to the mounting unit 4 (or, to be placed on the placing surface 4A) as it is.

In fact, if the DAP 2 received in a silicon cover is placed on the placing surface 4A, the lower end portion of the DAP 2 is inserted between the front convex portion 4C and the rear convex portion 4D with substantially no gap by the thickness of the silicon cover.

In this way, the cradle apparatus 3 may support the DAP 2 received in the silicon cover by means of the front and rear convex portions 4C and 4D and the connector 4B inserted into the connector of the DAP 2 and may allow the DAP 2 to be stably placed on the placing surface 4A.

In addition, the cradle apparatus 3 has an attachment 6 which allows an uncovered DAP 2 not received in a silicon cover or clear casing to be stably placed.

The attachment 6 may be detachably mounted to the mounting unit 4, and the attachment 6 includes a front portion 6A having a thickness of several millimeters and contacting the inner surface of the front convex portion 4C when being mounted and a rear portion 6B having a thickness of several millimeters and contacting the inner surface of the rear convex portion 4D when being mounted.

Figure 2B:
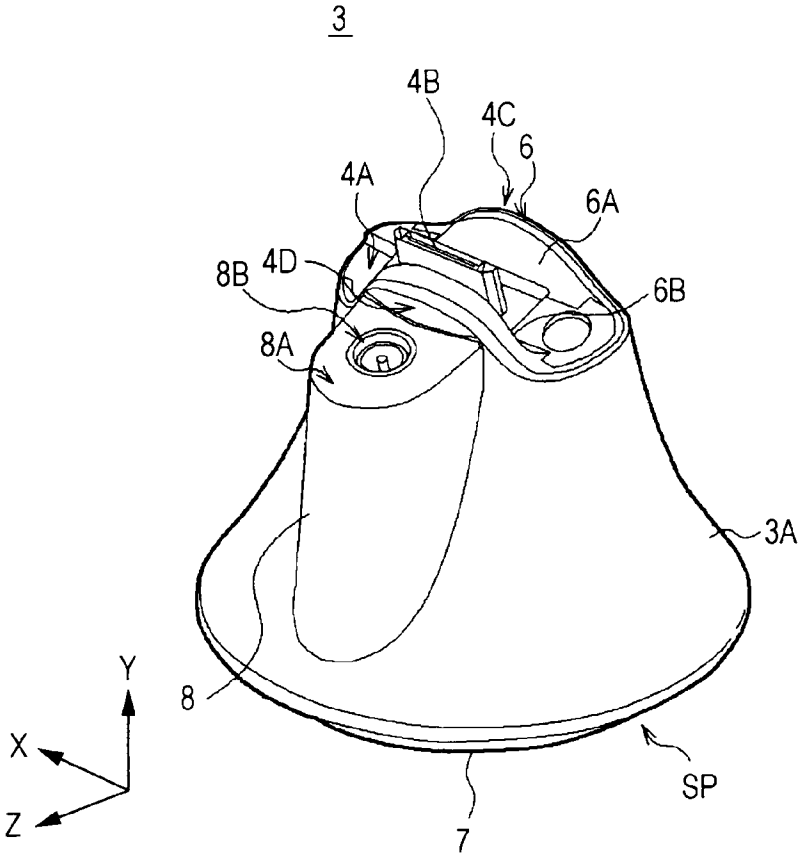
FIGS. 2A and 2B are schematic views showing an appearance of a cradle apparatus.
Figure 2A:
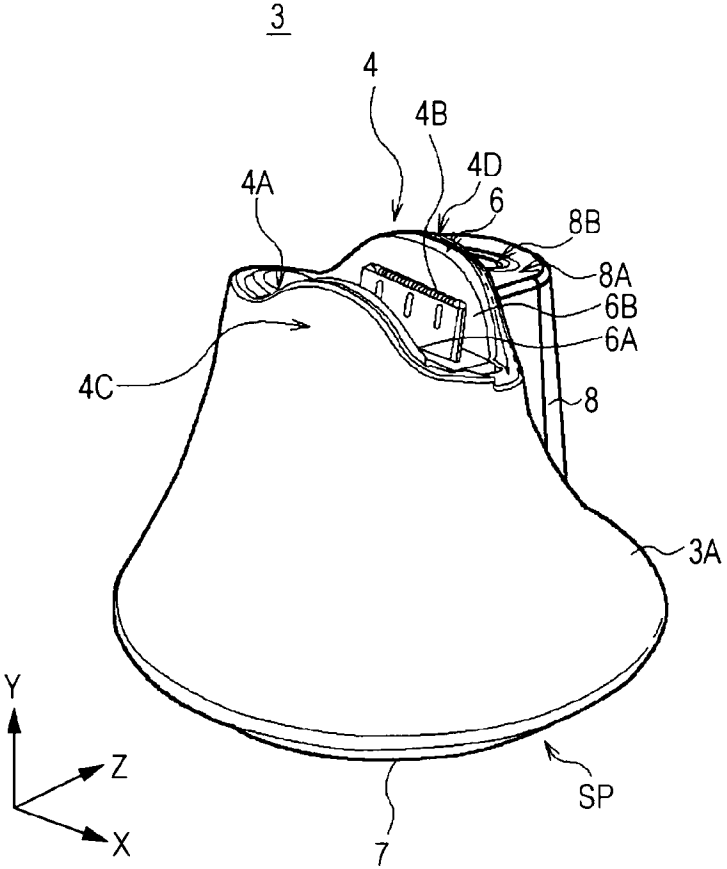
Figure 3:
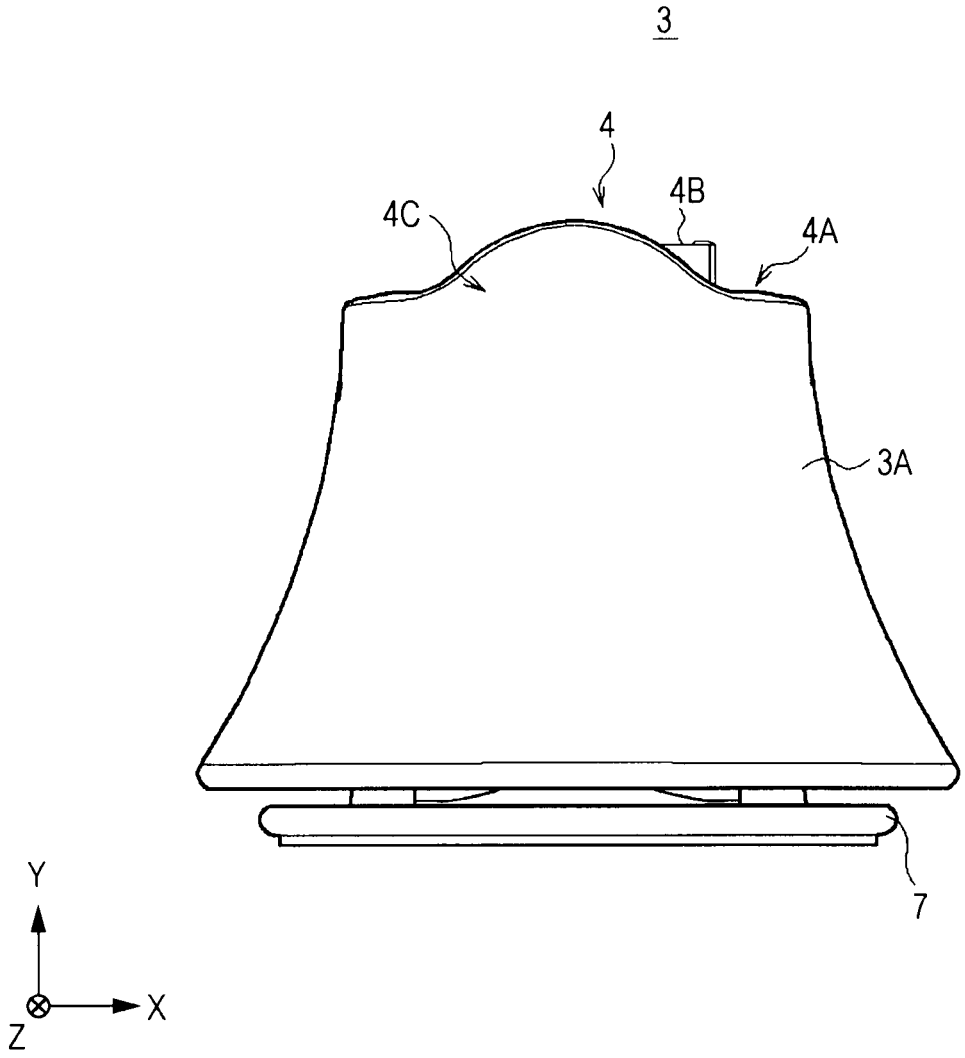
FIG. 3 is a schematic view showing an appearance of the cradle apparatus.
Figure 9:
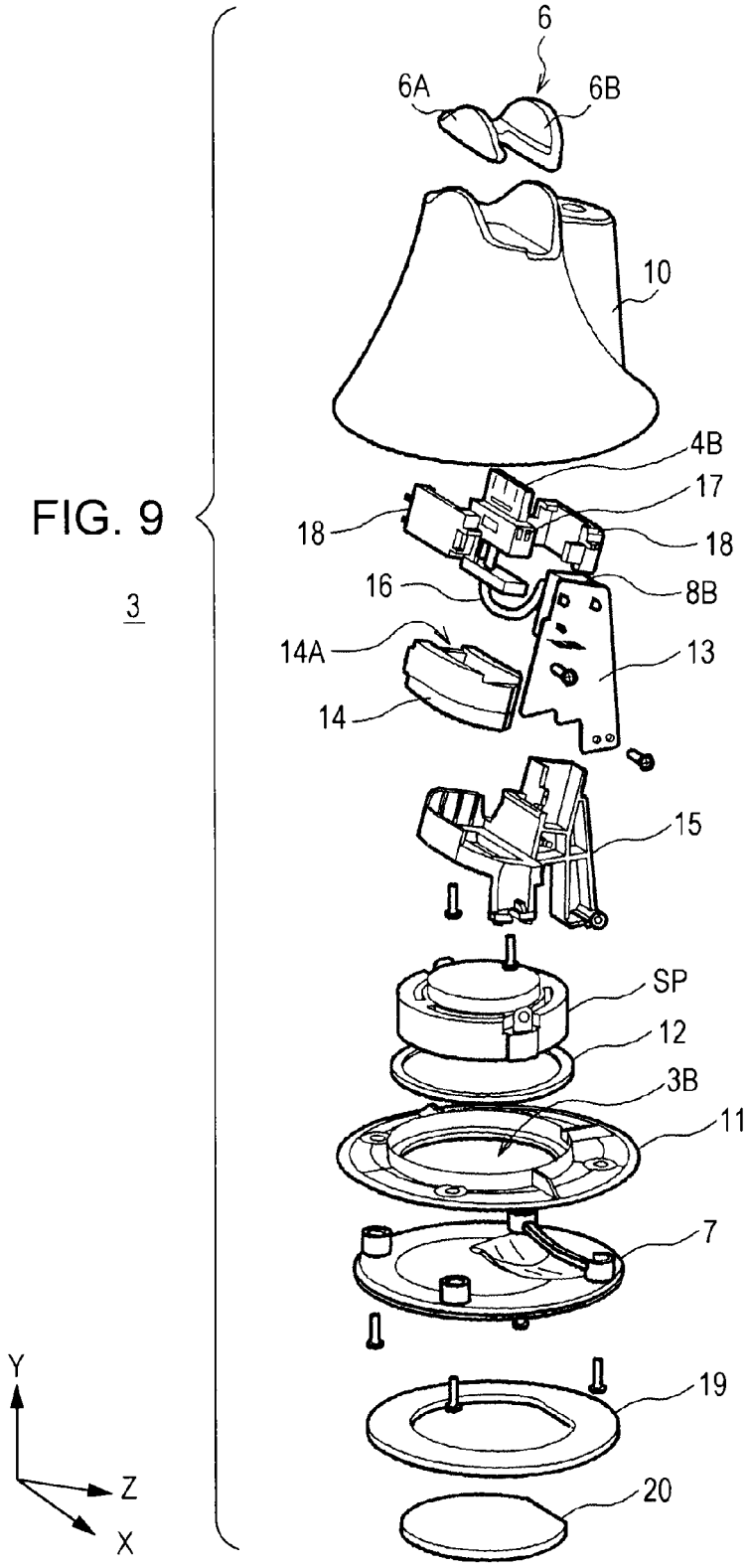
FIG. 9 is a schematic view showing detailed components of the cradle apparatus.

In addition, FIGS. 2A and 2B show the cradle apparatus 3 on which the attachment 6 is mounted, and FIG. 9 shows a cradle apparatus 3 from which the attachment 6 is detached as described later.

Here, in fact, in a state in which the attachment 6 is mounted, the uncovered DAP 2 is placed on the placing surface 4A. By doing so, the front portion 6A and the rear portion 6B of the attachment 6 are located between the front and rear convex portions 4C and 4D and the lower end portion of the uncovered DAP 2 so that the lower end portion of the uncovered DAP 2 is inserted between the front portion 6A and the rear portion 6B with no gap.

In this way, the cradle apparatus 3 may support the uncovered DAP 2 by means of the front convex portion 4C, the rear convex portion 4D, the connector 4B inserted into the connector of the DAP 2, and the attachment 6, and the uncovered DAP 2 may be placed on the placing surface 4A in a stable state.

In addition, in the cradle apparatus 3, since the placing surface 4A of the mounting unit 4 is not perfectly parallel to the installation such as a floor but inclined so that its rear side is oriented downwards, when the DAP 2 is placed, the front surface portion of the DAP 2 is inclined upwards.

Moreover, the term 'horizontal' used herein does not represent a direction perpendicular to the gravity direction but represents a direction parallel to the installation surface such as a floor on which the cradle apparatus 3 is placed.

Figure 4A:
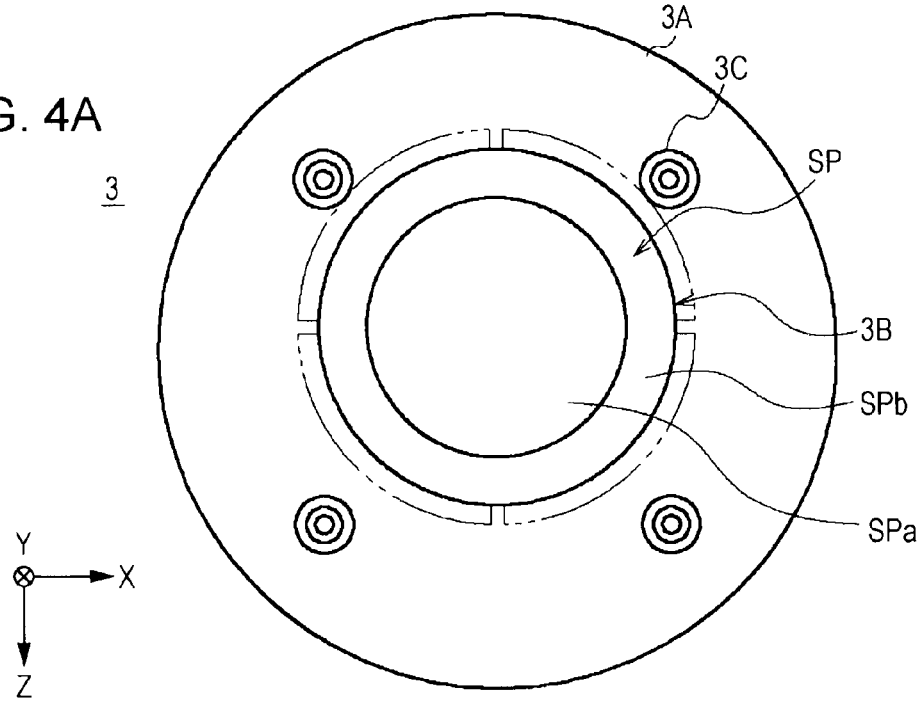
FIGS. 4A and 4B are schematic views showing an appearance of the cradle apparatus.

Meanwhile, the bottom portion of the casing 3A has a sufficiently great circular shape in comparison to the upper end portion, as shown in FIGS. 2A, 2B, and 4A. In addition, as shown in FIGS. 2A to 3, the side surface portion of the casing 3A has a smoothly spreading curve from the upper end portion over the bottom portion. In this way, the casing 3A has a bottom-spreading bell shape as a whole.

In addition, as the casing 3A has the above shape, the cradle apparatus 3 may look like an integrated form as a whole when the DAP 2 is placed on the upper end portion of the casing 3A, as shown in FIG. 1B.

Moreover, as shown in FIG. 4A, in the bottom portion of the casing 3A, a circular opening 3B greatly smaller than the bottom portion is formed adjacent to the front side of the bottom portion. In addition, from the opening 3B, a disk-shaped vibration plate SPa which is a part of the speaker SP and an edge SPb provided at the outer periphery of the corresponding vibration plate SPa are exposed in parallel to the bottom portion. In other words, the speaker SP is disposed at the bottom portion of the casing 3A so that the vibration plate SPa is oriented downwards.

Figure 4B:
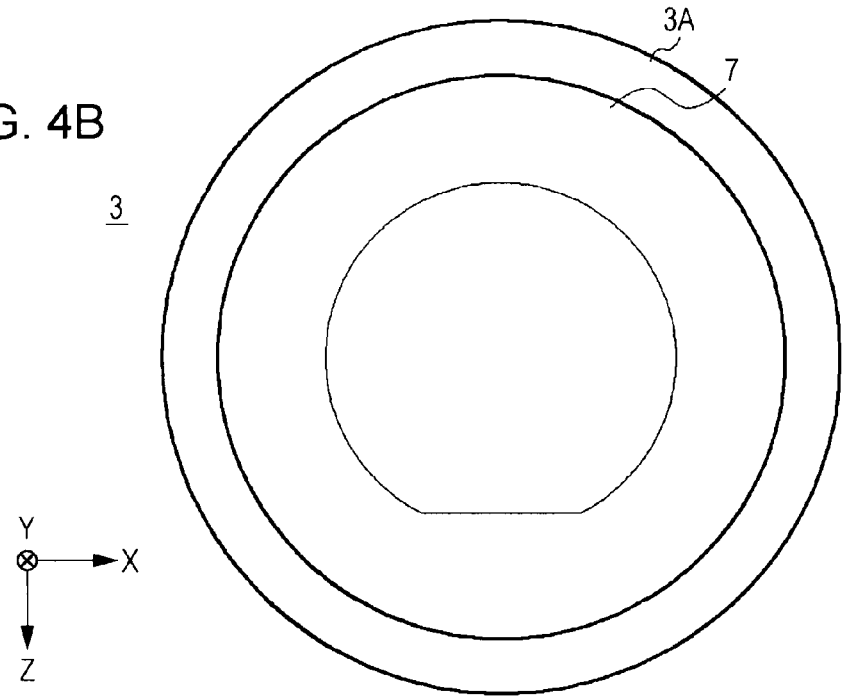

In addition, as shown in FIGS. 3 to 4B, a circular base plate 7 which is concentric with the bottom portion as a basis of the casing 3A is mounted to the bottom portion of the casing 3A in parallel with the bottom portion so that a gap of several millimeters is created between the base plate 7 and the bottom portion. The base plate 7 is sized to cover the entire circular opening 3B and to allow the casing 3A to be stably supported, and here, the size of the base plate 7 is 0.9 times that of the bottom portion for example.

Figure 5:
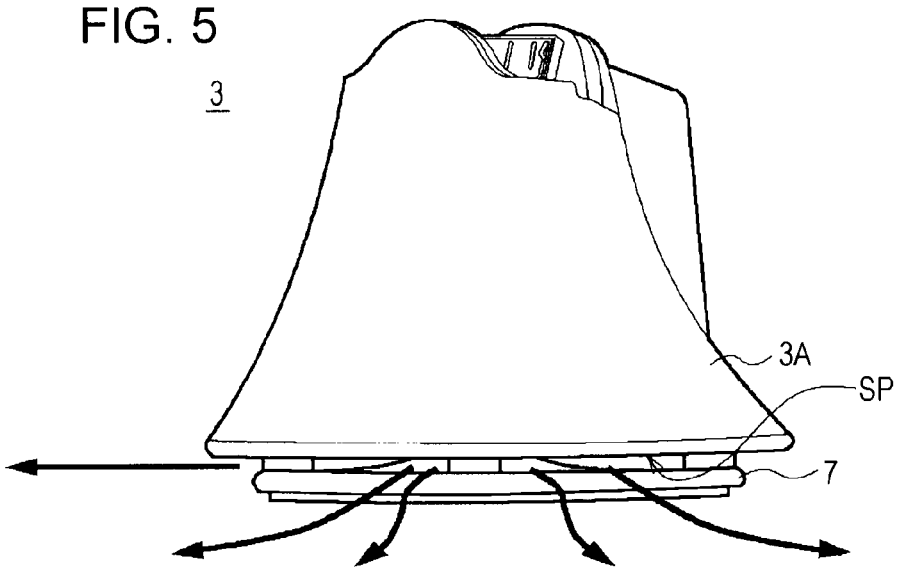
FIG. 5 is a schematic view illustrating how to diffuse a sound by a diffuser.

The base plate 7 functions not only as a base of the casing 3A but also as a diffusing plate which diffuses the sound generated downwards from a downward speaker SP located at the bottom portion of the casing 3A into a horizontal direction from the gap between the base plate 7 and the bottom portion, as shown in FIG. 5. Therefore, the base plate 7 is also called a diffuser (a diffusing plate) 7 here. In addition, the diffuser 7 will be described in more detail later.

As described above, the cradle apparatus 3 diffuses the sound generated from the downward speaker SP located at the bottom portion of the casing 3A into a horizontal direction from the gap between the diffuser 7 and the bottom portion, so that the sound may be heard by a listener at the front side.

In addition, the cradle apparatus 3 is configured to have the speaker SP which includes the downward vibration plate SPa only at the bottom portion of the casing 3A. In this way, if the bottom portion has a size corresponding to the speaker SP, the other portions may have any size as long as the cradle apparatus does not fall down even in a state in which the DAP 2 is mounted thereto, and the casing 3A may easily be miniaturized.

Moreover, as shown in FIGS. 2A and 2B, an AC adaptor connector 8 protruding rearwards and having a semi-cylindrical shape is formed at the rear side of the side surface portion of the casing 3A of the cradle apparatus 3.

Figure 6:
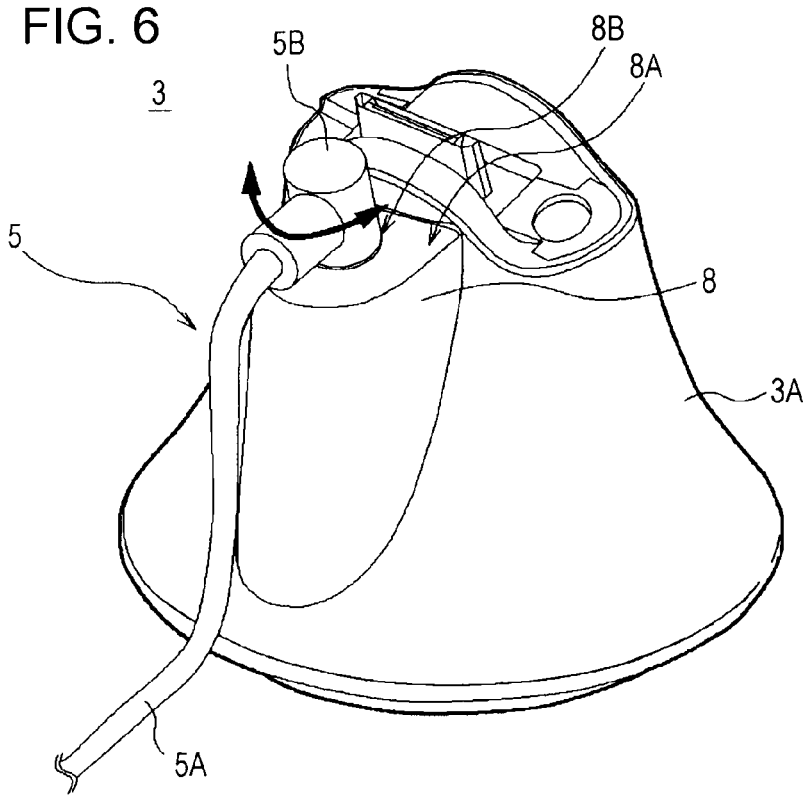
FIG. 6 is a schematic view illustrating the connection to an AC adaptor.

The AC adaptor connector 8 has a DC input terminal 8B provided at a flat surface 8A of the upper end portion thereof and having a downward circular hole shape. A plug (not shown) having a cylindrical shape and provided at the cable front end portion 5B of the cable 5A of the AC adaptor 5 is inserted into the DC input terminal 8B from above, as shown in FIG. 6, so that the AC adaptor 5 is connected to the cradle apparatus 3.

In addition, if the plug is inserted into the DC input terminal 8B, the cable front end portion 5B may enter a head-knocking state in a direction parallel to the flat surface 8A based on the plug inserted into the DC input terminal 8B.

Here, if the cable 5A of the AC adaptor 5 is pulled, the cable front end portion 5B head-knocks in the pulled direction. In this way, when the cable is pulled by the AC adaptor 5, the cradle apparatus 3 lessens the force which directly reaches the casing 3A, thereby preventing the casing 3A from falling.

In addition, the flat surface 8A of the upper end portion of the AC adaptor connector 8 is not perfectly horizontal but inclined so that its rear side is oriented downwards. In this configuration, the cable 5A of the AC adaptor 5 may be easily moved downwards from the upper end portion of the AC adaptor connector 8, and as a result the cable 5A may be easily wound up.

[1-3. Configuration of Diffuser]

Figure 7A:
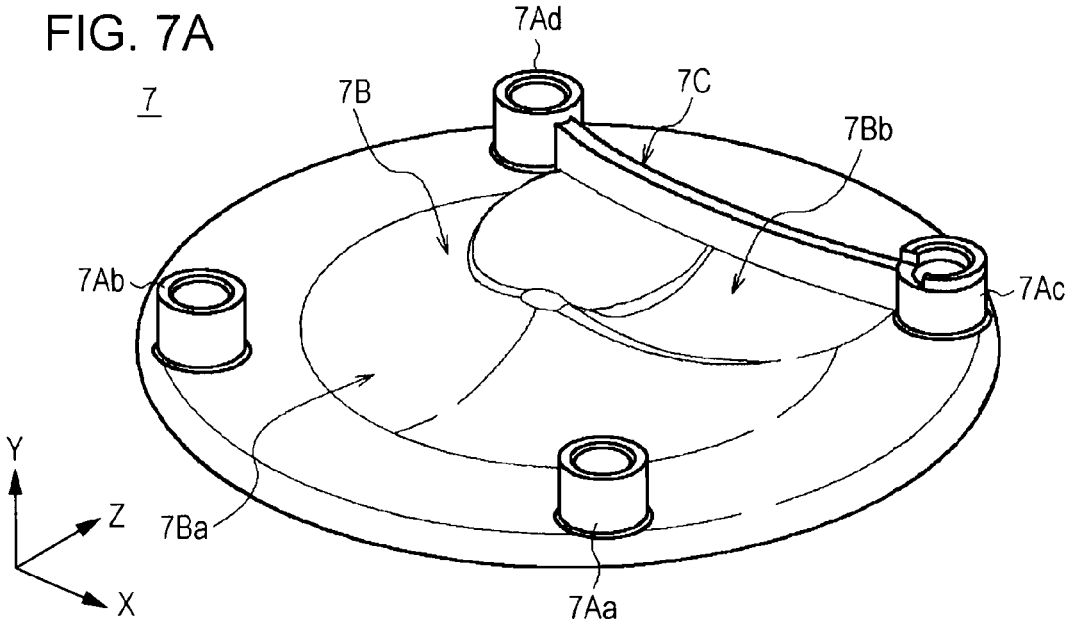
FIGS. 7A, 7B and 7C are schematic views showing a configuration of the diffuser.
Figure 7B:
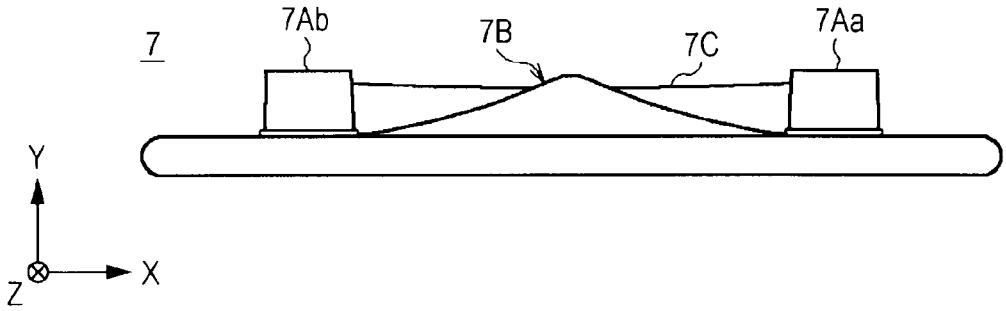
Figure 7C:
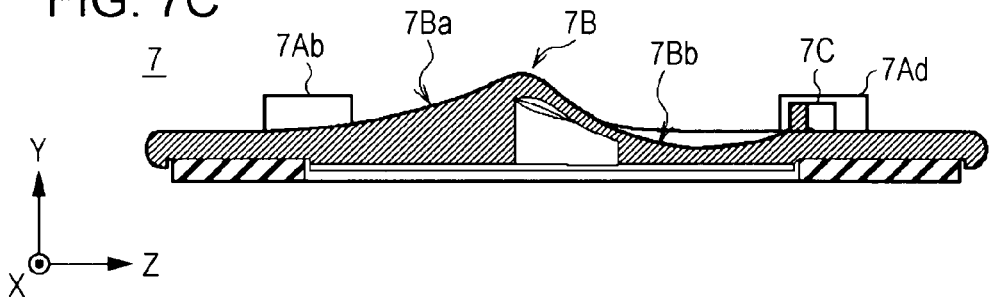
Figure 8:
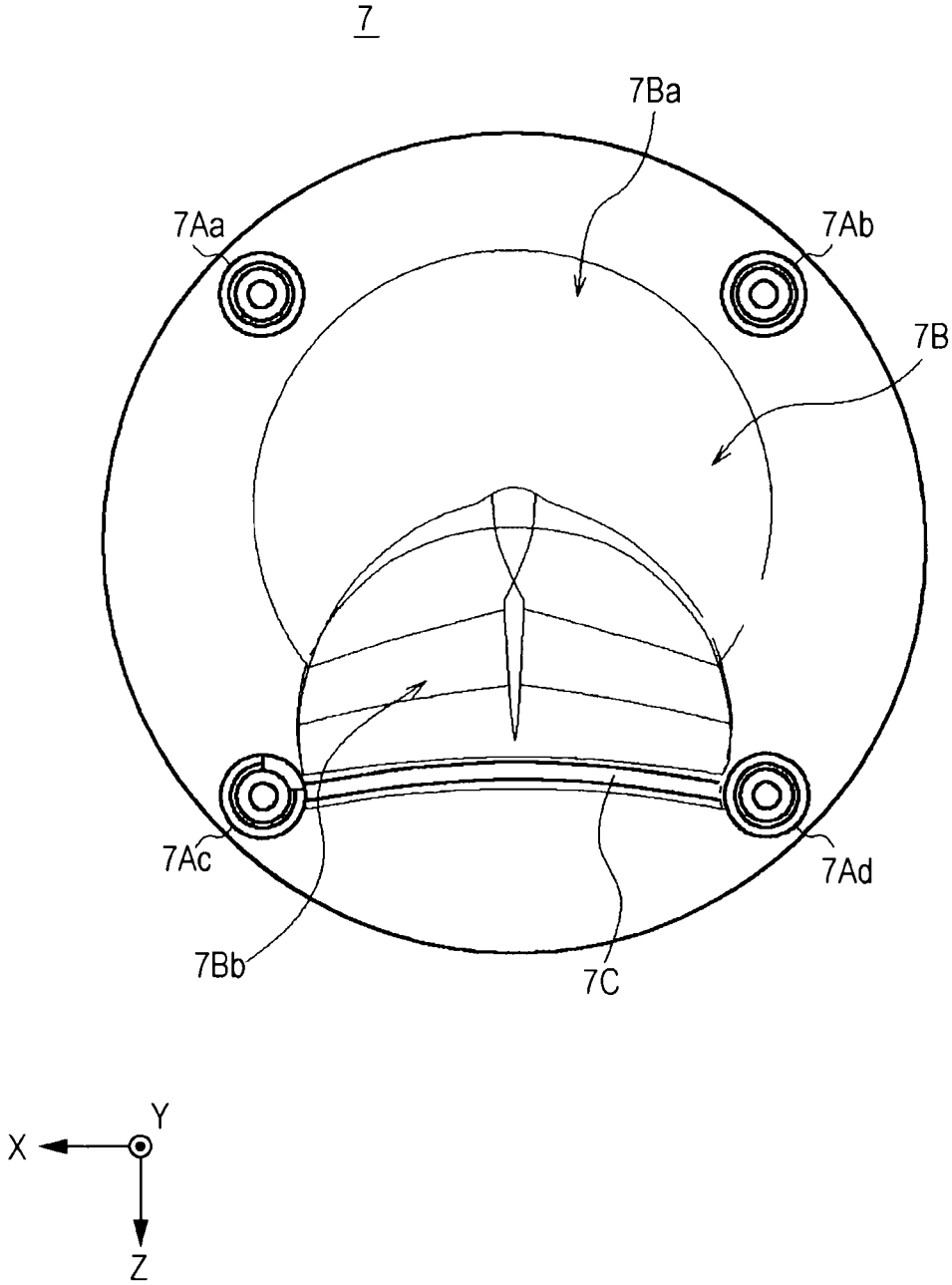
FIG. 8 is a schematic view showing a configuration of the diffuser.

Next, the configuration of the diffuser 7 mounted to the bottom portion of the casing 3A will be described in more detail with reference to FIGS. 7A to 8.

Four pillar portions 7A having a cylindrical shape extending upwards are formed at regular intervals on the outer periphery of the upper surface portion of the diffuser 7, which faces the bottom portion of the casing 3A.

Meanwhile, four diffuser mounting holes 3C having a circular hole shape are formed at regular intervals in the bottom portion of the casing 3A as shown in FIG. 4A, on the circumference which is further in than the outer periphery of the bottom portion and further out than the opening 3B.

In detail, the diffuser mounting holes 3C are formed at four locations, for example at 45 degrees in a front left direction, at 45 degrees in a front right direction, at 45 degrees in a rear left direction, and at 45 degrees in a rear right direction when being looked from the center of the bottom portion.

In addition, the upper end portions of the four pillar portions 7A (FIGS. 7A, 7B and 7C) formed at the upper surface portion of the diffuser 7 are inserted into the four diffuser mounting holes 3C so that the diffuser 7 is mounted to the bottom portion of the casing 3A.

At this time, the four pillar portions 7A formed at the upper surface portion of the diffuser 7 are respectively located at 45 degrees in a front left direction, at 45 degrees in a front right direction, at 45 degrees in a rear left direction, and at 45 degrees in a rear right direction when being looked from the center of the upper surface portion.

In addition, these four pillar portions 7A are set to have their height so that a gap of a predetermined width is created between the upper end portion of the diffuser 7 and the bottom portion of the casing 3A when the pillar portions 7A are mounted to the bottom portion of the casing 3A.

Further, here, the pillar portion 7A located at 45 degrees in a front left direction is called a front left pillar portion 7Aa, the pillar portion 7A located at 45 degrees in a front right direction is called a front right pillar portion 7Ab, the pillar portion 7A located at 45 degrees in a rear left direction is called a front left pillar portion 7Ac, and the pillar portion 7A located at 45 degrees in a rear right direction is called a front right pillar portion 7Ad.

In addition, a mountain-shaped convex portion 7B having a top at a location opposite to the center of the vibration plate SPa of the speaker SP disposed at the bottom portion of the casing 3A is formed in the upper surface portion of the diffuser 7, at an inner side of the four pillar portions 7Aa to 7Ad.

The convex portion 7B has a circular shape based on the top, when viewed from directly above, and includes a front slant portion 7Ba covering about 270 degrees ranging from about 45 degrees in a rear left direction to about 45 degrees in a rear right direction, when attached to the casing 3A and viewed from the top, and a rear slant portion 7Bb covering about 90 degrees in a rear direction in the other range.

The front slant portion 7Ba slants to smoothly descend from the top to the outer flat surface of the convex portion 7B. In detail, the slant of the front slant portion 7Ba is formed to form, for example, a curve bending downwards. In addition, the outer flat surface of the convex portion 7B is a plane parallel to the vibration plate SPa of the speaker SP.

Meanwhile, a dent depressed downwards from the flat surface is formed in the rear slant portion 7Bb at its center location. The rear slant portion 7Bb slants downwards from the top to the dent at a steeper angle than the front slant portion 7Ba, and further slants upwards smoothly from the dent to the outer flat surface.

In addition, a wall portion 7C perpendicular to the flat surface is formed at the upper surface portion of the diffuser 7 at the rear of the rear slant portion 7Bb to range from the rear left pillar portion 7Ac to the rear right pillar portion 7Ad.

The wall portion 7C has a bow shape bent forwards, and the height of the wall portion 7C is set to be identical to the width of the gap created between the bottom portion of the casing 3A and the surface of the diffuser 7.

Therefore, if the diffuser 7 is mounted to the bottom portion of the casing 3A, the rear side of the rear slant portion 7Bb is clogged by the wall portion 7C.

In a state in which the diffuser 7 configured as above is mounted to the bottom portion of the casing 3A, it is assumed that a sound is generated downwards from the downward speaker SP provided at the bottom portion of the casing 3A.

Then, the sound is partially diffused in a horizontal direction in the range of about 270 degrees in a front direction by the slant of the front slant portion 7Ba of the convex portion 7B and is emitted from the gap between the bottom portion of the casing 3A and the upper surface portion of the diffuser 7 as shown in FIG. 5.

As described above, the diffuser 7 may diffuse the sound generated downwards from the downward speaker SP into a horizontal direction in the range of about 270 degrees in a front direction based on the casing 3A.

In this way, the cradle apparatus 3 may allow a listener located at the front of the cradle apparatus 3 to listen to the sound generated downwards from the downward speaker SP provided at the bottom portion of the casing 3A.

In addition, the cradle apparatus 3 diffuses a sound in a horizontal direction in the range of about 270 degrees forwards based on the casing 3A to improve directivity so that a listener may listen to a sufficient sound even though the listener is not at the front side of the casting 3A.

In addition, the cradle apparatus 3 allows a listener to listen to a sonorous sound by diffusing a sound and improving directivity as described above.

Further, the sound generated downwards from the downward speaker SP is partially oriented rearwards due to the slant of the rear slant portion 7Bb of the convex portion 7B and is reflected on the wall portion 7C formed at the rear side of the rear slant portion 7Bb to be oriented forwards. In other words, the wall portion 7C functions as a reflector which reflects the sound oriented rearwards toward the front side.

As described above, among the sounds generated downwards from the downward speaker SP, a sound which will leak rearwards is reflected on the wall portion 7C to be oriented forwards by the diffuser 7.

As a result, the sound diffused forwards by the front slant portion 7Ba of the convex portion 7B of the diffuser 7 and the sound reflected forwards by the wall portion 7C are combined and reach a listener who is located at the front of the cradle apparatus 3.

Here, since the convex portion 7B is formed at the front of the wall portion 7C, among the sound reflected on the wall portion 7C, low-pitched components generally move back to the front side, and as a result the low-pitched components of the sound diffused forwards are increased.

In this way, the cradle apparatus 3 may allow a listener to listen to a sound with increased low-pitched components.

In addition, since the wall portion 7C has a bow shape bent forwards, the diffuser 7 may reflect the sound which will leak rearwards, so that the sound spreads forwards due to the wall portion 7C.

In this way, the cradle apparatus 3 may increase a low-pitched sound by combining the sound reflected on the wall portion 7C and the sound diffused forwards by the front slant portion 7Ba of the convex portion 7B, without decreasing the directivity of sound.

In addition, due to the dent formed in the rear slant portion 7Bb, the diffuser 7 may lessen the attenuation of the sound which is caused by the interference of the sound oriented rearwards and the sound reflected on the wall portion 7C, between the rear slant portion 7Bb and the wall portion 7C.

In this way, the diffuser 7 may allow the sound reflected on the wall portion 7C to be oriented forwards in an efficient way, and the low-pitched components of the sound may be improved more effectively.

As described above, the cradle apparatus 3 realizes broad directivity and sufficient generation of a low-pitched sound by the diffuser 7, while providing just one speaker SP at the bottom portion of the small casing 3A.

[1-4. Details of Each Component of Cradle Apparatus]

Figure 10:
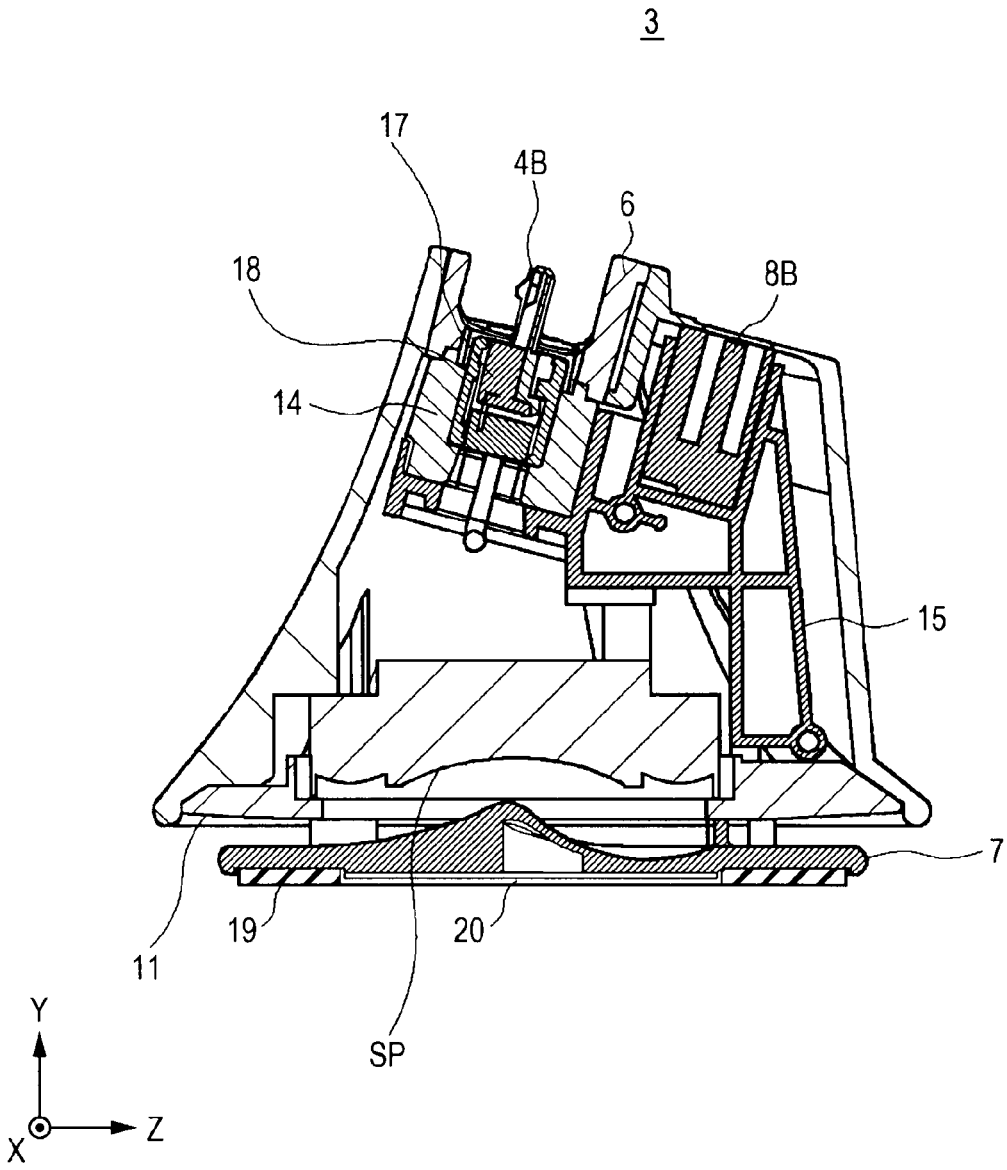
FIG. 10 is a schematic view showing detailed components of the cradle apparatus.

Next, details of each component of the cradle apparatus 3 will be described with reference to FIGS. 9 and 10. The cradle apparatus 3 includes the casing 3A, the diffuser 7, and the attachment 6, as described above.

The exterior of the casing 3A includes a top cover 10 forming a side portion from the upper end portion and a baffle plate 11 forming the bottom portion, and the baffle plate 11 is fixed to the bottom of the top cover 10 by a screw.

The baffle plate 11 is a so-called plate to which the speaker SP is mounted, and the speaker SP is mounted so that the vibration plate SPa and the edge SPb are exposed through the opening 3B formed in the baffle plate 11.

Here, a vibration-proof cushion 12 is interposed between the speaker SP and the baffle plate 11 so that the vibration of the speaker SP is not transmitted directly to the baffle plate 11 and the top cover 10.

In addition, a main substrate 13 having various circuits such as a power circuit and an amplifying circuit formed at predetermined locations therein and a bracket 15 holding a silicon damper 14 which absorbing a force applied to the connector 4B are fixed by screws to the top cover 10.

The DC input terminal 8B is fixedly attached to the main substrate 13 so that the circuit on the main substrate 13 is connected to the DC input terminal 8B. The circuit on the main substrate 13 is operated using power supplied from the AC adaptor 5 via the DC input terminal 8B.

In addition, a connector substrate 17 is connected to the circuit on the main substrate 13 via a wiring cable 16, and also the speaker SP is connected thereto via a wiring cable, not shown.

The connector substrate 17 has a rectangular shape, and the connector 4B is fixedly attached to the upper surface portion and a wiring cable 16 is connected to the bottom portion.

The side portion of the connector substrate 17 is covered by a connector holder 18, and in this state, the connector substrate 17 is inserted into a mounting hole 14A formed in a vertical direction in the damper 14 so that the connector substrate 17 is mounted to the damper 14.

The mounting hole 14A has the same shape and the same size as the side portion of the connector holder 18, and the connector substrate 16 covered by the connector holder 18 is mounted to be closely adhered to the mounting hole 14A of the damper 14 without any gap.

As described above, in the cradle apparatus 3, the connector substrate 17 to which the connector 4B is fixedly attached is not fixed in the casing 3A but mounted to the silicon damper 14 so that the damper 14 is fixed in the casing 3A.

In this way, if a force is actually applied to the connector 4B, the silicon damper 14 deforms so that the connector 4B and the connector substrate 17 slant. By this, it is possible to prevent the force applied to the connector 4B from being directly applied to the connection portion of the connector 4B and the connector substrate 17 and thus prevent the connector 4B from being bent.

Therefore, the cradle apparatus 3 may improve the strength around the connector 4B of the casing 3A.

In addition, in this case, the strength may be improved just with a simple configuration where the silicon damper 14 is just interposed between the connector substrate 17 and the bracket 15.

Meanwhile, the diffuser 7 is fixed by a screw to the baffle plate 11. In addition, a ring-shaped rubber foot 19 is fixedly attached to the bottom portion of the diffuser 7, and a name plate 20 where a model name or the like is recorded is fixedly attached to the inner side of the foot 19.

In addition, the foot 19 is thicker than the name plate 20, and the foot 19 becomes a region contacting a floor or the like.

[1-5. Operation and Effects]

In the configuration as described above, the cradle apparatus 3 is configured so that the downward speaker SP is provided at the bottom portion of the casing 3A having a bottom-spreading bell shape as if a brass musical instrument such as a trumpet were to stand with its front end portion being oriented downwards.

As described above, by providing the downward speaker SP only to the bottom portion of the casing 3A, if the size of the bottom portion is set depending on the speaker SP, the other portions may have any size as long as the cradle apparatus does not fall down even in a state in which the DAP 2 is mounted thereto. In this way, the casing 3A may easily be miniaturized.

In addition, in the cradle apparatus 3, the diffuser 7 is mounted to the bottom portion of the casing 3A to create a gap of several millimeters between the bottom portion of the casing 3A and the diffuser 7.

The mountain-shaped convex portion 7B having a top at a location opposite to the center of the vibration plate SPa of the speaker SP disposed at the bottom portion of the casing 3A is formed on the diffuser 7.

The cradle apparatus 3 diffuses the sound generated downwards from the speaker SP into a horizontal direction by the convex portion 7B so that the sound is emitted from the gap between the bottom portion of the casing 3A and the diffuser 7.

In this way, the cradle apparatus 3 may allow a listener located at the front of the cradle apparatus 3 to listen to the sound generated downwards from the speaker SP.

In addition, the cradle apparatus 3 may improve the directivity of the sound by diffusing the sound generated from the speaker SP by means of the convex portion 7B.

Moreover, the diffuser 7 reflects the sound, which will leak rearwards, into a front direction by the wall portion 7C formed at the rear side of the convex portion 7B so that low-pitched components of the emitted sound are increased.

In this way, the cradle apparatus 3 may realize broad directivity and sufficient generation of a low-pitched sound by providing just one speaker SP at the bottom portion of the small casing 3A.

In this configuration, in the cradle apparatus 3, the casing 3A may easily have a small size while the speaker SP is provided thereto, and the cradle apparatus 3 may realize broad directivity and sufficient generation of a low-pitched sound by using the small casing 3A.

2. Modification

[2-1. Modification 1]

In addition, in the above embodiment, the case where the present disclosure is applied to the cradle apparatus 3 on which the DAP 2 is placed has been described. However, it is also possible to exclude the mounting unit 4 from the cradle apparatus 3 and to apply the present disclosure to, for example, a speaker device having a speaker terminal at a rear side of the side portion of the casing 3A, without being limited to the above.

In addition, it is also possible to exclude the mounting unit 4 from the cradle apparatus 3 and apply the present disclosure to a music reproduction device having a storage unit for storing music data, a reproduction unit for reproducing the music data, and a sound amplifying unit such as a digital amplifier in the casing 3A.

In other words, the present disclosure may be applied to various electronic devices other than the above, if a speaker is disposed only at the bottom portion of the casing.

[2-2. Modification 2]

In addition, in the above embodiment, one speaker SP is provided to the bottom portion of the casing 3A, but it is also possible to provide a plurality of speakers to the bottom portion of the casing 3A, for example by arranging two speakers right and left, without being limited to the above.

In this case, convex portions corresponding to the speakers respectively may be provided to the upper surface portion of the diffuser 7.

[2-3. Modification 3]

In addition, in the above embodiment, the mounting unit 4 is provided at the upper end portion of the casing 3A, but it is also possible to provide the mounting unit 4 to any location of the casing 3A, without being limited to the above.

For example, a region protruding forwards may be formed at the side portion of the casing 3A so that the mounting unit 4 is provided thereto.

[2-4. Modification 4]

In addition, in the above embodiment, each circuit of the cradle apparatus 3 is operated using power supplied from the AC adaptor 5 via the DC input terminal 8B serving as an external connection terminal. However, without being limited to the above, when the AC adaptor 5 is not connected, it is also possible to obtain power from the DAP 2 via the connector 4B and to operate each circuit of the cradle apparatus 3 by this power.

In addition, it is also possible to exclude the AC adaptor connector 8 from the casing 3A and to operate each circuit of the cradle apparatus 3 by only the electricity obtained from the DAP 2. In this case, it is difficult to charge the DAP 2, but it is easier to carry the cradle apparatus 3.

Moreover, it is also possible to form a USB connector instead of the AC adaptor connector 8 at the rear side of the side portion of the casing 3A so that a USB cable is connected to a USB connection terminal provided at the USB connector to obtain power via USB.

In addition, in this case, the cradle apparatus 3 may serve as a relay to establish data communication between the DAP 2 placed on the cradle apparatus 3 and a device connected to the cradle apparatus 3 by the USB.

[2-5. Modification 5]

In addition, in the above embodiment, the connector substrate 17 covered by the connector holder 18 is mounted to the silicon damper 14.

However, without being limited thereto, a rubber damper may be used instead of the silicon damper as long as the dumper has an elastic material capable of absorbing the force applied to the connector 4B, and a spring may also be used instead of the bumper.

[2-6. Modification 6]

In addition, in the above embodiment, the casing 3A has a bottom-spreading bell shape as if a brass musical instrument such as a trumpet were to stand with its front end portion being oriented downwards. However, without being limited thereto, if the speaker SP is provided only to the bottom portion, the casing 3A may have various shapes such as a can shape, a cylindrical shape, a conical shape, a box shape, and so on.

[2-7. Modification 7]

In addition, in the above embodiment, the wall portion 7C is provided at the rear side of the convex portion 7B at the upper surface portion of the diffuser 7 so that the sound which will leak to the rear side is reflected forwards by the wall portion 7C.

However, without being limited to the above, the wall portion 7C may be excluded from the upper surface portion of the diffuser 7. In this configuration, the sound leaks rearwards and thus the low-pitched components do not increase, but the sound is emitted even in a rear direction of the casing 3A to the extent that the directivity of sound is improved. Even in this case, since the wall portion 7C does not exist, the rear slant portion 7Bb of the convex portion 7B may have the same slant as the front slant portion 7Ba.

In addition, without being limited to the above, the location and height of the top of the convex portion 7B, the shape of the slant, the ranges of the front slant portion 7Ba and the rear slant portion 7Bb, the length, height, and bending of the wall portion 7C, and the location, number, shape, and height of the pillar portion 7A may be changed differently from the above embodiment.

In fact, if these factors are changed, the sound emitting from the cradle apparatus 3 is changed. Therefore, these factors may be changed by the audio system 1 according to the directivity and the intensity of low-pitched sound.

For example, it is also possible that the wall portion 7C is bent rearwards, not forwards, that the location of the top of the convex portion 7B is moved to the center of the wall portion 7C, or that three pillar portions 7A are provided to right and left locations of the front side and a center of the rear side.

In addition, though the diffuser 7 has a circular shape in the above embodiment, the diffuser 7 may have various shapes other than the above, for example a triangular shape or a rectangular shape, without being limited to the above.

[2-8. Modification 8]

In addition, in the above embodiment, the diffuser 7 is fixed by a screw to the bottom portion of the casing 3A. However, without being limited to the above, the casing 3A and the diffuser 7 may be integrally formed. In this case, for example, the casing 3A integrally formed with the diffuser 7 may be configured with a front part and a rear port so that both parts are fixed by a screw with each other.

[2-9. Modification 9]

In addition, in the above embodiment, the diffuser 7 is mounted to the bottom portion to be in parallel with the bottom portion of the casing 3A. In this case, the bottom portion of the casing 3A becomes parallel with the installation surface.

However, without being limited to the above, for example, among the pillar portions 7A of the diffuser 7, the pillar portion 7A at the front side may be designed to be higher than the pillar portion 7A at the rear side so that the bottom portion of the casing 3A is inclined with its front side ascending.

In this configuration, the vibration plate SPa of the speaker SP is oriented not into a right downward direction but to a direction slanting forwards, so that the sound may be easily diffused forwards.

[2-10. Modification 10]

In addition, in the above embodiment, the attachment 6 is provided so that both an uncovered DAP 2 and a DAP 2 received in a silicon cover or a clear casing may be stably mounted to the cradle apparatus 3.

However, without being limited to the above, it is also possible to provide an attachment corresponding to the DAP 2 with various shapes other than the above.

[2-11. Modification 11]

In addition, the present disclosure is not limited to the above embodiments and modifications. In other words, the scope of the present disclosure covers a partial or whole combination of the embodiments and modifications, or partial extractions thereof.

The present disclosure contains subject matter related to that disclosed in Japanese Priority Patent Application JP 2010-205943 filed in the Japan Patent Office on Sep. 14, 2010, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A cradle apparatus, comprising:

a casing;

a mounting unit provided to the casing so that an electronic device is mounted thereto;

a speaker provided at a bottom portion of the casing, wherein the speaker emits a sound in a downward direction away from the casing, wherein the sound is generated based on sound signals received from the electronic device;

a diffusing plate comprising a convex portion formed at an upper surface portion of the diffusing plate, wherein the upper surface portion faces towards the bottom portion of the casing comprising the speaker, wherein the convex portion of the diffusing plate diffuses the sound generated downwards from the speaker into a direction parallel to the installation surface; and a reflector provided at a rear side of the convex portion at the upper surface portion of the diffusing plate so that the sound diffused rearwards is reflected forwards, wherein a wall of the reflector is a bow shaped and bent towards the convex portion.

2. The cradle apparatus according to claim 1, wherein the diffusing plate is mounted with the casing to create a gap between the diffusing plate and the bottom portion of the casing comprising the speaker so that the sound generated downwards from the speaker is diffused from the gap.

3. The cradle apparatus according to claim 1, wherein the diffusing plate comprises a top of the convex portion at a location opposite to a center of the vibration plate, wherein the convex portion diffuses the sound generated downwards from the speaker into a direction parallel to the installation surface by the slant thereof.

4. The cradle apparatus according to claim 1, wherein a dent is formed at a rear slant portion of the convex portion, wherein the rear slant portion descends from the top of the convex portion to the dent on the outer flat surface of the convex portion at a first angle of descend which is steeper than a second angle of descend of a front slant portion from the top of the convex portion to the outer flat surface of the convex portion.

5. The cradle apparatus according to claim 1, wherein the bottom portion of the casing has a bottom-spreading bell shape, and wherein the mounting unit is provided at an upper end portion of the casing.

6. The cradle apparatus according to claim 1, further comprising an attachment detachably mounted to the mounting unit in order to mount electronic devices of various shapes.

7. The cradle apparatus according to claim 1, further comprising an external connection terminal provided to the casing so that a cylindrical plug of an external connection cable is inserted therein from an upper position.

8. The cradle apparatus according to claim 1, wherein a connector substrate is held in the casing while a damper made of elastic material is interposed therein, and wherein a connector attached to the connector substrate is exposed from the mounting unit of the casing.

9. The cradle apparatus according to claim 8, wherein the damper is either a silicon damper or a rubber damper.

10. The cradle apparatus according to claim 1, wherein the diffusing plate comprises the convex portion with a top, a front slant portion, a rear slant portion and an outer flat surface, wherein the front slant portion slants to form a first curve bending downwards from the top of the convex portion to the outer flat surface of the convex portion, wherein the rear slant portion slants to form a second curve bending downwards from the top of the convex portion to a dent on the outer flat surface of the convex portion.

11. The cradle apparatus according to claim 10, wherein the rear slant portion further slants to form a third curve bending upwards from the dent to the outer flat surface of the convex portion.

12. The cradle apparatus according to claim 10, wherein the front slant portion facing the front direction with respect to the casing covers 270 degrees of the diffusing plate horizontally and 90 degrees of the diffusing plate horizontally in the rear direction.

13. The cradle apparatus according to claim 1, wherein the diffusing plate is circular and has a size corresponding to the speaker.

14. The cradle apparatus according to claim 1, further comprising an external connection terminal provided on a flat surface on the casing, wherein the rear side of the flat surface is inclined downwards such that a plug inserted into an external connection terminal head-knocks in a pulled direction of a cable connected to the plug.

15. The cradle apparatus according to claim 1, wherein the wall of the reflector is perpendicular to a flat surface formed at the upper surface portion of the diffusing plate.

16. The cradle apparatus according to claim 1, wherein height of the wall of the reflector is same as width of a gap created between a bottom portion of the casing and the diffusing plate.

* * * * *